United States Patent [19]

Häggström

[11] 4,294,092

[45] Oct. 13, 1981

[54] CYLINDER LOCK HAVING SPRING-ACTUATED PINS

[75] Inventor: Åke T. L. Häggström, Lycksele, Sweden

[73] Assignee: GKN-Stenman AB, Eskilstuna, Sweden

[21] Appl. No.: 120,961

[22] Filed: Feb. 13, 1980

[30] Foreign Application Priority Data

Feb. 13, 1979 [SE] Sweden ..... 7901266

[51] Int. Cl.[3] ..... E05B 27/04

[52] U.S. Cl. ..... 70/364 A; 70/373; 70/375

[58] Field of Search ..... 70/364 A, 358, 372, 70/373, 374, 375, 376, 378, 416, 419

[56] References Cited

U.S. PATENT DOCUMENTS 1,047,483 12/1912 Augenbraun ..... 70/364 A 3,413,831 12/1968 Crepinsek ..... 70/364 A 3,656,328 4/1972 Hughes ..... 70/364 A

*Primary Examiner*—Robert L. Wolfe

*Attorney, Agent, or Firm*—Sughrue, Mion, Zinn, Macpeak and Seas

[57] ABSTRACT

In a cylinder lock (1) one or more (2*a*, 3*a*) for locking pins (5) are formed in the cylinder housing (2) and the cylindrical body (3), and the bores in the cylinder housing have a slope relative to a normal to the axis of the cylinder housing. When the cylindrical body is rotated through 180° by a correctly inserted key, a crescent-shaped part of each pin engages the wall of the cylinder housing so that the pins are held in the cylindrical body (2) without falling out through the mouths (2*a*') of said bores, although said mouths are not plugged. The problem of producing a simple and inexpensive method of manufacture for a cylindrical lock having a smaller number of elements than known locks is thus satisfactorily solved. The slope angle is suitably from 2° to 3°.

4 Claims, 3 Drawing Figures

CYLINDER LOCK HAVING SPRING-ACTUATED PINS

The present invention relates to a cylinder lock having a housing in which there is arranged a cylindrical body which, when a key is inserted correctly into said lock, can be rotated through at least 180°, said housing and said cylindrical body each being provided with a plurality of bores accommodating spring-actuated pins which may comprise two or more parts or sections and the inner ends of which coincide with the bit or web of the key.

Such previously known locks are provided with bores which accommodate said pins and which extend at right angles to the cylinder housing or the cylindrical body. The bore in the cylinder housing extends from the peripheral surface thereof into the wall of the housing on the other side of the housing cavity in which the cylindrical body is housed. The bore of the cylindrical body can extend in a corresponding manner from its peripheral surface, it being necessary to take great care so that the pin holes in the cylindrical body and the cylinder housing are exactly in line with each other when the cylindrical body is introduced into said housing.

The mouths of the bores in the cylinder housing are plugged prior to mounting the cylinder. An object of the present invention is to provide a cylindrical lock of the aforedescribed kind, which can be manufactured in a much simpler and cheaper manner.

The U.S. Pat. No. 3,413,831 describes a cylinder lock whose cylindrical body and cylinder housing are provided with apertures having differing angles relative to the sides of the key. In this case, the pin-accommodating bores have been given differing angles in order to increase the number of possible combinations of the lock in its entirety, and to reduce the possibilities of being able to force the lock. A lock of this kind, however, requires a much more complicated method of manufacture than that required for a normal cylinder lock.

The U.S. Pat. No. 1,905,177 describes a lock whose cylindrical body has three or four slots extending at angles to each other. Each such slot is intended to receive a separate key for co-operation with a corresponding number of rows of locking pins, said rows thus also forming a corresponding angle with one another. This design is also intended to render forcing of the lock difficult. The requirement of several keys and the large number of pins which must be provided render the lock, however, relatively expensive.

The U.S. Pat. No. 1,932,363 describes a lock having a separate means in the form of an oblique plunger which engages the cylindrical body and blocks its movement when an attempt is made to open the lock with the aid of an instrument other than the correct key. The increased number of lock elements also renders the lock as a whole more expensive and more complicated.

A cylinder lock in accordance with the present invention is characterized in that one or more of the bores is or are inclined relative to the axis of the cylinder housing, so that a part of the outer end of a corresponding pin accommodated in the cylindrical body will, subsequent to rotating the key through 180°, engage the inner surface of the cylinder housing and be held in the cylindrical body without plugging the mouths of the bores in the cylindrical housing.

A cylindrical lock constructed in accordance with the invention greatly reduces the production costs of the lock without neglecting the requisite reliability of said lock, namely because plugging of the mouths of said bores, or the covering of said mouths in some other way, is unnecessary. In actual fact, the cylinder lock according to the invention is a safer lock than known locks, because the risk of plugs being loosened and the pins falling down as a result hereof is eliminated. These advantages can be achieved, despite the fact that the number of working operations required when manufacturing the elements of the lock is reduced in relation to conventional locks.

Tests have shown that the angles of the bores relative to a normal to the cylinder axis should be between 1° and 5°, and suitably between 1.5° and 4°. The preferred angle has been found to lie between 2° and 3°.

From the point of view of manufacture it has been found best to provide the cylinder housing with the oblique bores, while the bores through the cylindrical body should extend perpendicularly to its axis. The main reason for this is that such a design does not require comprehensive modification of the keys or key blanks intended for use with a cylinder lock according to the invention.

To avoid the risk of the pins sticking or wedging in the transition region between straight and inclined bores, it is preferred that one or both of the bores in the transition region is or are provided with a widened, suitably conical region.

An exemplary embodiment of the invention will now be described with reference to the accompanying schematic drawings, in which FIG. 1 is a cross-sectional view of a cylinder lock made in accordance with the invention.

Figure 1:
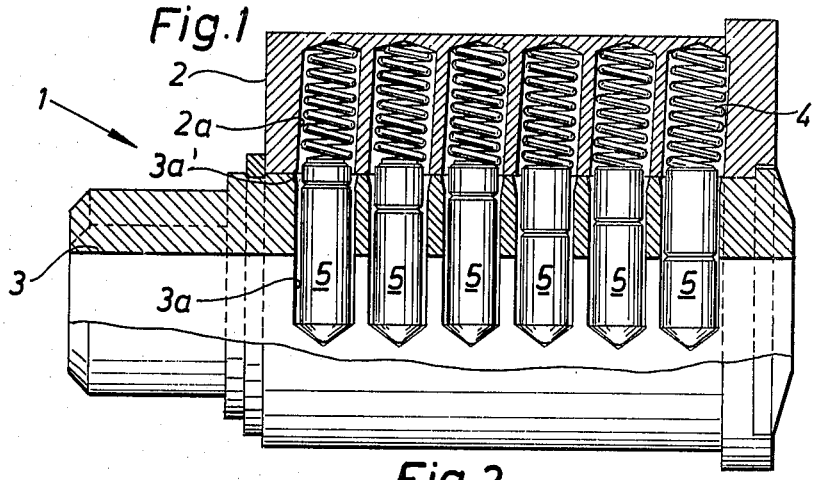

A cylinder lock 1 comprises a cylinder housing 2 having a circular-cylindrical cavity in which a cylindrical body 3 is arranged for rotation.

The cylinder housing 2 and the cylindrical body 3 have a plurality of bores 2*a*, and 3*a* respectively, which accommodate pins 5 biassed by springs 4, each of which pins in the illustrated embodiment comprises at least two sections.

Figure 2:
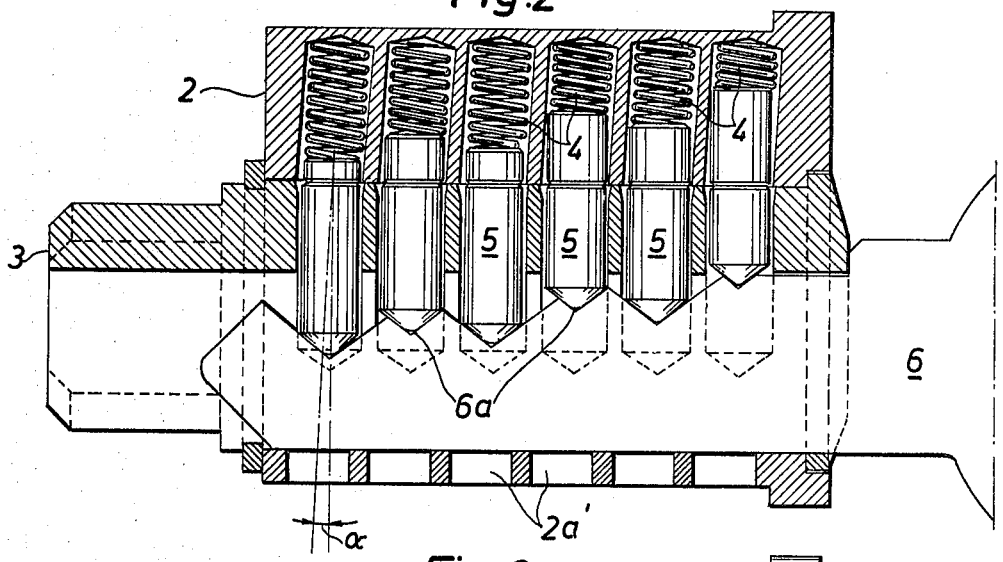
FIG. 2 is a sectional view corresponding to that of FIG. 1, subsequent to inserting a key into the lock.
Figure 3:
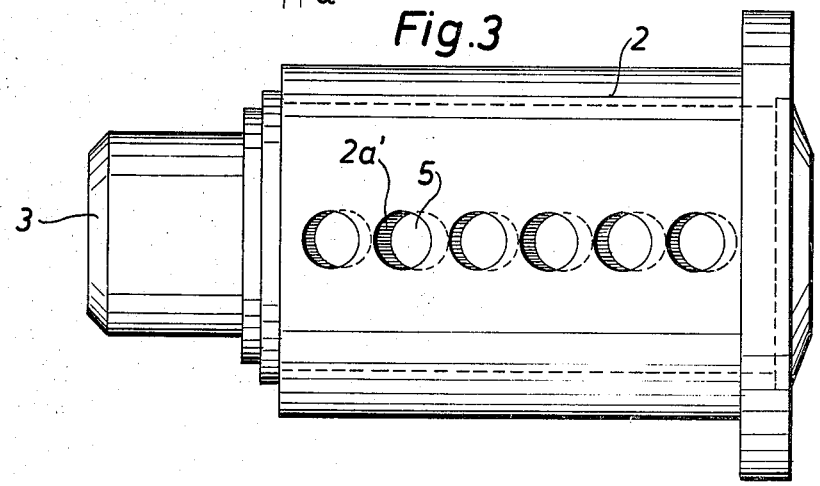
FIG. 3 is a bottom plan view of the cylinder lock shown in FIG. 1.

When a key 6, shown in FIG. 2, is inserted correctly into the cylindrical body 3, the bit 6*a* of the key acts on the inner ends of the pins 5, so that the dividing or parting plane between the various parts of each of the pins 5 coincides with the parting plane between the outer surface of the cylindrical body 3 and the surface which defines the axially extending inner cavity in the cylinder housing 2. The cylindrical body 3 can, in this way, be turned through 180° by means of the key 6. This rotary position of the key is illustrated in FIG. 3, which shows the positions of the pins in relation to the bore of the cylinder housing. The key is then turned through a further 180°, whereafter it can be removed from the lock.

In accordance with the invention, the bores 2*a* extend in the cylinder housing 2 in a manner to form an angle $\alpha$ with the normal to the axis of the cylinder housing. In the illustrated embodiment, the bores 3*a* in the cylindrical body extend, however, at right angles to the axis of said body. The angle $\alpha$ is about 2.5°.

As will be seen from FIG. 3, a crescent-shaped part of the outer end of the pins 5 accommodated in the cylindrical body 3 engage the inner surface of the cylinder housing subsequent to the cylindrical body being rotated through 180°, from the position shown in FIG. 2 to the position shown in FIG. 3. The pins will thus be held in the cylindrical body, without it being necessary to plug the mouths 2*a*′ of the bores 2*a* in the cylinder housing.

In order to avoid the pin sections wedging in the region of the parting plane between the cylindrical body and the cylinder housing, at least part of adjacent ends of the bores 2*a* and 3*a* respectively is preferably widened. It will be seen in this respect, e.g. from FIG. 1, that the mouths of the bores 3*a* exhibit a conical widened-area 3*a*′.

It will be gathered from the above, that in accordance with an alternative embodiment (not illustrated) the bores in both the cylinder housing and the cylindrical body can form an angle $\alpha$.

In this case, that part of the pin 5 which co-operates with the bit 6*a* of the key will thus have an inclination relative to said bit, which thus presumes another design of the engagement surface of the pin and/or the key bit.

In a further alternative embodiment, the bores of both the cylinder housing and cylindrical body are inclined relative to respective axes, the inclination of said bores, however, differing in respect of the two elements.

The best functioning of the lock is obtained when the angle $\alpha$ is between 2° and 3°. Acceptable results, however, are also obtained when said angle $\alpha$ lies within the range of 1.5–4°. When the angle $\alpha$ is less than 1° or greater than 5°, it is possible that the lock will not function in the manner intended. Thus, if the angle is less than 1° the pins may leave the cylinder housing. If the angle is greater than 5°, there is a greater risk of the locking pins sticking.

I claim:

1. A cylinder lock, comprising: a cylinder housing (2), a cylindrical body (3) mounted in said housing for rotation through at least 180° when a correct key is inserted into said lock, said housing and said cylindrical body individually defining a first parallel set and a second parallel set of communicating bores, and a plurality of spring-actuated pins individually accommodated within said first and second sets of bores, each pin comprising at least two parts and inner ends of said pins cooperating with a bit of the key, at least one of said sets of bores being inclined relative to a normal to the axis of the cylinder housing to partially axially offset the first and second sets of bores subsequent to rotating the cylindrical body through 180° and prevent the pin parts within the cylindrical body from falling out.

2. A cylinder lock according to claim 1, wherein one of said sets of bores forms an angle of 1°–5°, suitably 1.5°–4° and preferably 2°–3° to a normal to the axis of the cylinder housing.

3. A cylinder lock according to claim 1, wherein the cylinder housing has inclined bores, while the bores through the cylindrical body extend at right angles to its axis.

4. A cylinder lock according to claim 1, wherein the bores of one set have conically widened end openings.

* * * * *